United States Patent [19]

Grauer et al.

[11] Patent Number: 4,771,675

[45] Date of Patent: Sep. 20, 1988

[54] SWABBING APPARATUS

[75] Inventors: James E. Grauer, Granbury; Douglas E. McLaughlin, Joshua, both of Tex.

[73] Assignee: Petro Rubber Hi-Tec, Inc., Joshua, Tex.

[21] Appl. No.: 935,177

[22] Filed: Nov. 26, 1986

[51] Int. Cl.[4] ..... F16J 9/00

[52] U.S. Cl. ..... 92/242; 92/240

[58] Field of Search ..... 92/242, 180 R, 245, 92/247, 240, 241

[56] References Cited

U.S. PATENT DOCUMENTS

| | | | |
|---|---|---|---|
| 2,674,201 | 1/1951 | Talbott | 417/513 |
| 2,975,722 | 3/1967 | Webber | 417/554 |
| 3,209,660 | 10/1965 | Taylor | 92/180 |
| 3,266,385 | 8/1966 | Scaramucci | 92/242 |
| 3,352,212 | 11/1967 | Read | 92/192 |
| 3,487,753 | 1/1970 | Read et al. | 92/242 |

*Primary Examiner*—Robert E. Garrett
*Assistant Examiner*—Thomas Denion
*Attorney, Agent, or Firm*—Arthur F. Zobal; James C. Fails; Geoffrey A. Mantooth

[57] ABSTRACT

A swabbing apparatus has a plurality of swab cups molded on a single core, with at least two swab cups having a different fluid load carrying capacity, so that the swabbing apparatus will have a relatively broad fluid load carrying capacity. Each swab cup has one or more lips with the fluid load carrying capacity of a swab cup being determined primarily by lip thickness.

9 Claims, 1 Drawing Sheet

SWABBING APPARATUS

FIELD OF THE INVENTION

The present invention relates to swabbing apparatus of the type commonly used to swab well casing or tubing, particularly oil or gas well casing or tubing.

BACKGROUND OF THE INVENTION

Swabbing apparatus of the relevant type usually comprises a hollow core for receiving lifting apparatus such as the mandrel of a wireline workover unit. In conventional swabbing apparatus a plurality of working lips, which are made of elastomeric material and which all have the same fluid load carrying capacity, are molded onto the core. These lips are capable of carrying only a relatively narrow range of fluid loads; thus, the entire swabbing apparatus is useful only over the same narrow range of fluid loads. This fluid load carrying capacity may be broadened slightly by adding support lips beneath the working lips. Such an approach is exemplified by Read U.S. Pat. No. 3,352,212. For swabbing the various ranges of fluid loads that are encountered downhole, a particular swabbing apparatus that is designed for each such particular range of fluid loads, must be used. The particular range of fluid loads that will be encountered by a swabbing apparatus at a job site will not be definitely known by the workover operator and he must consequently guess at which particular swabbing apparatus would be best to use. The fact that each swabbing apparatus is useful over only a narrow range of fluid loads is disadvantageous. Since the well site is usually in a location remote from a source of supply, the workover operator must have in his truck inventory swabbing apparatuses of several different diameters to cover the various casing or tubing diameters that will be encountered, with several swabbing apparatuses of different load ranges for each such diameter. This adds up to the necessity for a large inventory of swabbing apparatuses. A swabbing apparatus having a relatively broad range of load carrying capacities would alleviate the problems discussed above. Although some efforts have been made to provide swabbing apparatuses having a relatively broad range of load carrying capacities, the resulting swabbing apparatus has not proved to be entirely satisfactory.

It is accordingly the objective of this invention to provide an improved swabbing apparatus that has a relatively broad range of fluid load carrying capacities.

DESCRIPTION OF A PREFERRED EMBODIMENT

Figure 1:
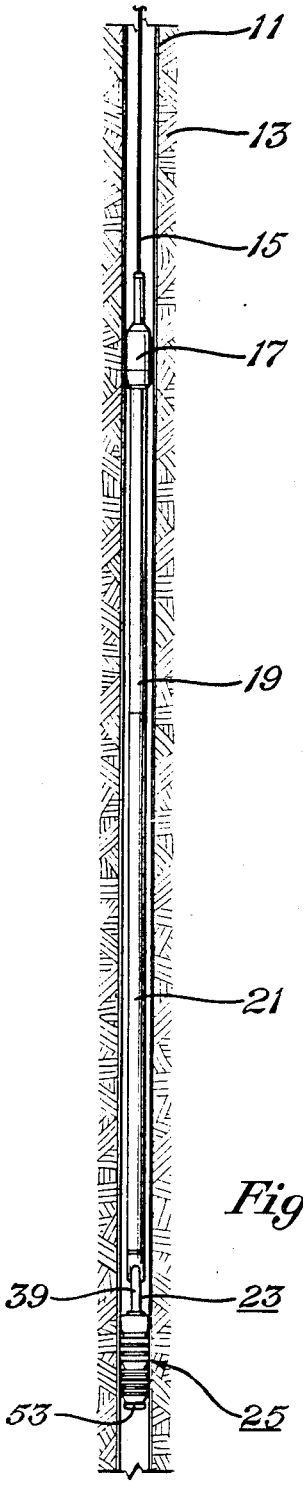
FIG. 1 is a schematic vertical cross-sectional view of a portion of an oil well in which there is shown a swabbing apparatus of the present invention, in accordance with a preferred embodiment.

In FIG. 1 there is shown a vertical cross sectional view of a portion of an oil well which comprises casing 11 fixed into the ground 13. Producing oil wells commonly suffer decreases in production due to a build up of deposits on the interior of the casing or tubing. Wireline workover rigs are employed to remove the deposits and to restore the well to normal production. A swabbing unit, such as is shown in FIG. 1, is used in the final steps of the cleaning process to clear unwanted workover fluids from the well and to restore production. The swabbing unit includes a wireline 15, a rope socket 17, a tubular jar 19, a sinker bar 21, a mandrel 23, all of which are conventional, and a swabbing apparatus 25 of the present invention in accordance with a preferred embodiment.

Figure 2:
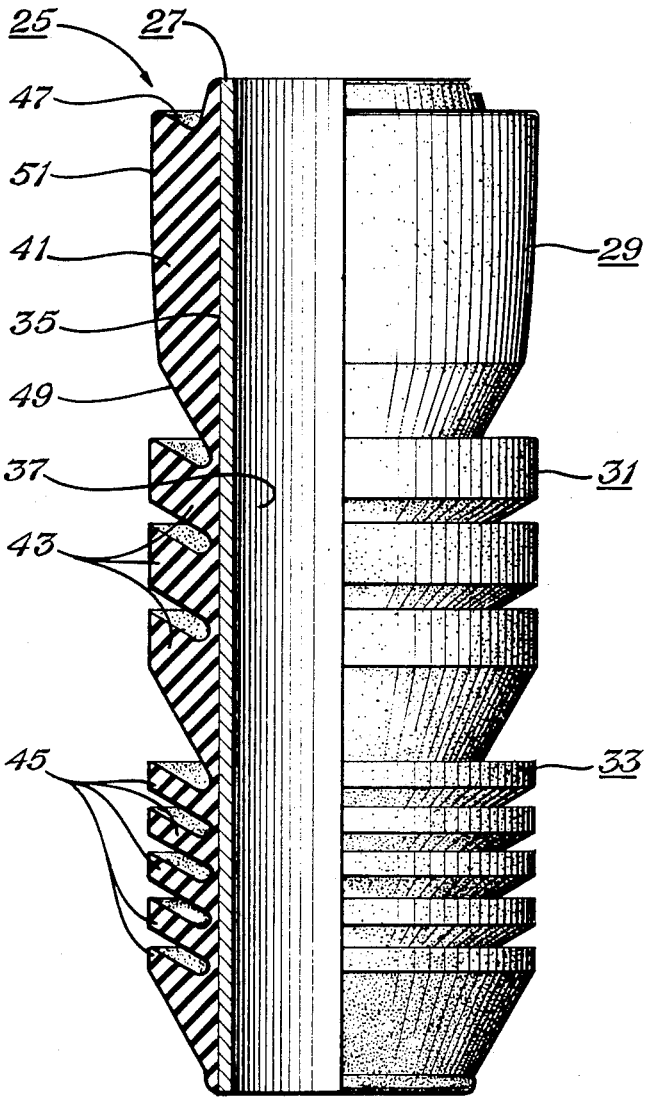
FIG. 2 is a schematic longitudinal partial cross-sectional view of the swabbing apparatus of FIG. 1.

Referring to FIG. 2, the swabbing apparatus 25 of the present invention, which includes a core 27 and a plurality of swab cups 29, 31, 33, will now be described.

The core 27 is a cylindrical tube which has an outer portion 35 and an inner portion 37. The inner portion 37 comprises a cylindrical cavity that receives the stem portion 39 of the mandrel 23. The core 27 is made out of a suitable material such as aluminum or steel so as to provide a rigid support for the swab cups 29, 31, 33.

The individual swab cups are categorized according to their fluid load carrying capacity, of which more will be explained hereinafter. In the preferred embodiment, there are provided a heavy load swab cup 29, a medium load swab cup 31, and a light load swab cup 33. The swab cups 29, 31, 33, which are made of elastomeric material, are molded together in an integral manner and are secured to the core outer portion 35 by a suitable bonding agent.

Each swab cup has one or more lips arranged longitudinally along the core 27. In the preferred embodiment, the heavy load swab cup 29 has a single lip 41, the medium load swab cup 31 has several lips 43, and the light load swab cup 33 has even more lips 45. The lips, which project radially outward, have an upward inclination and pro3ect a sufficient distance so as to have some flexibility of movement. Each lip has an upper surface 47, a lower surface 49, and a thickness which is the distance between the lip upper and lower surfaces. The heavy load swab cup lip 41 is thicker than the individual medium load swab cup lips 43 which in turn are thicker than the individual light load swab cup lips 45. Each lip also has an outside surface 51 that merges with the respective lip upper and lower surfaces 47, 49. The lip outside surfaces are all cylindrical with the exception of the outside surface of the heavy load swab cup lip 41 which tapers radially inward from the heavy load swab cup lip upper surface to the heavy load swab cup lip lower surface. Thus, the respective medium load and light load swab cup lips 43, 45 have outside diameters which are equivalent to the diameters of the respective cylindrical outside surfaces. For the heavy load swab cup lip 41, the outside diameter is the diameter of that portion of the heavy load swab cup lip outside surface nearest the heavy load swab cup lip upper surface. The respective outside diameters are uniform among the lips in a swab cup and are also uniform from swab cup to swab cup. The outside diameter of an individual swabbing apparatus 25 is sized slightly less than the inside diameter of the casing 11. This allows fluid located beneath the swabbing apparatus 25 to pass between the lip outside surfaces 51 and the interior surface of the casing 11 as the swabbing apparatus is lowered inside of the casing.

The individual swab cups are longitudinally arranged along the core 27 such that when the lips of a swab cup are undergoing movement due to a fluid load being applied to the lip upper surfaces, the lowermost lip of that swab cup is unsupported by the uppermost lip of the adjacent lower swab cup. Thus, as can be seen in FIG. 2, the heavy load swab cup 29 is spaced longitudinally far enough away from the medium load swab cup 31 so that when the heavy load swab cup lip 41 is loaded from above and moves toward the medium load swab cup, the heavy load swab cup lip 41 will not be supported by the uppermost medium load swab cup lip 43. The same is true for the position of the medium load swab cup 31 relative to that of the light load swab cup 33.

Each swab cup, with its one or more lips, has a carrying capacity for a predetermined range of fluid loads. In addition, each swab cup has a carrying capacity for a range of fluid loads which is different from the fluid load carrying capacities of other swab cups on the same core 27. Thus, in the preferred embodiment, there are provided a heavy load swab cup 29, a medium load swab cup 31, and a light load swab cup 33. The terms "heavy", "medium", and "light" are used to describe the fluid load carrying capacity of a particular swab cup and are defined as those terms are generally understood in the well swabbing art. Various factors contribute to the fluid load carrying capacity of a swab cup, including lip structure and the type of elastomeric material used. Lip structure encompasses both lip thickness and the distance a lip extends outwardly. Of the various factors contributing to the fluid load carrying capacities of the swab cups, lip thickness is the primary factor in determining the fluid load carrying capacity of a swab cup relative to the fluid load carrying capacities of the other swab cups on the same core. By increasing lip thickness, the fluid load carrying capacity of the respective swab cup increases. Likewise, by decreasing lip thickness, the fluid load carrying capacity decreases.

In swabbing a well, a swabbing apparatus 25 having an outside diameter that is slightly smaller than the inside diameter of the casing 11 is selected and installed onto the mandrel 23 with the stem portion 39 of the mandrel being received by the core inner portion 37 and the bottommost portion of the swabbing apparatus resting on the base portion 53 of the mandrel (see FIG. 1). The mandrel 23 is then coupled to the bottommost portion of the sinker bar 21 and the whole swabbing unit is lowered into the well by the wireline 15. The swabbing unit is lowered down into the fluid column so that some fluid is above the swabbing apparatus 25. The wireline 15 then retrieves the swabbing unit from the well, and the mandrel 23 lifts the swabbing apparatus 25 upwardly. As the swabbing apparatus is lifted up inside of the well casing, the fluid above the apparatus loads the lip upper surfaces 47, causing the lip outside surfaces to deflect downward and outward and sealing engage the casing.

In order for the lips of a particular swab cup to deflect outward and seal against the casing, the respective lips must be properly loaded. If the fluid load above the lips is too light, the respective lips will not deflect sufficiently and will allow fluid to pass. If the fluid load is too heavy, the respective lips will deflect too much and will break the sealing engagement between the lips and the casing, thereby allowing fluid to pass. Several factors contribute to the determination of the fluid load on a swab cup, including the amount of fluid the swab cup is attempting to lift, the rate of lift, the density of the fluid, and the viscosity of the fluid. The latter two factors vary from well to well, while the former two are controllable by the operator, who is able to select how much fluid he wants the swabbing apparatus to lift and also the rate of lift. In the embodiment shown, the medium or the heavy load swab cups will lift the fluid load if the light load swab cup is too heavily loaded. Likewise if a fluid load is too light for the heavy load swab cup, either the medium or the light load swab cups will lift the fluid load.

The essence of the present invention is that it incorporates on a single core a plurality of swab cups that are capable of carrying different ranges of fluid loads with a resultant broadening of the range of fluid loads that can be lifted up out of a well. The broadening of the fluid load carrying capacity of the swabbing apparatus is accomplished primarily by varying lip thickness from swab cup to swab cup. Such a broadening is advantageous in that it allows an operator to reduce his inventory of swab cups that must be carried out to a well site in his truck. In addition, with a broader lift capability, much of the guesswork an operator must use in matching the proper swab cup to the proper load is eliminated so that the swabbing operation can be more efficient and economical.

The foregoing disclosure and the showings made in the drawings are merely illustrative of the principles of the invention and are not to be interpreted in a limiting sense.

We claim:

1. A swabbing apparatus, comprising:

a. core means for providing a rigid support and for receiving lifting means, said core means having an outer portion, b. a plurality of swab cups made of elastomeric material and secured to said core means outer portion, each of said swab cups having a carrying capacity for a predetermined range of fluid loads, c. each of said swab cups having one or more lips; each lip having an upper surface, a lower surface, a thickness which is the distance between the upper and lower surfaces, and an outside diameter; said lips projecting outwardly a sufficient distance such that the lips have sufficient flexibility of movement to accomplish sealing action when said lip upper surfaces are subjected to a fluid load within the respective swab cup fluid load carrying capacity, d. said swab cups longitudinally arranged along said core means such that the lowermost lip of a swab cup is unsupported by the uppermost lip of the adjacent lower swab cup when said lowermost lip is undergoing movement due to the lowermost lip upper surface being subjected to a fluid load within the respective swab cup fluid load carrying capacity, e. at least two of said swab cups having different fluid load carrying capacities, f. wherein said fluid load carrying capacity of each swab cup relative to the fluid load carrying capacities of the other swab cups on the same core means is determined primarily by lip thickness.

2. The swabbing apparatus of claim 1 wherein said core means comprises a cylindrical tube.

3. The swabbing apparatus of claim 1 comprising at least three swab cups, all of which have different fluid load carrying capacities.

4. The swabbing apparatus of claim 1 wherein the lips of all of the swab cups on the same core means have a uniform outside diameter.

5. The swabbing apparatus of claim 1 wherein each swab cup has lips of uniform thickness.

6. The swabbing apparatus of claim 3 wherein the lips of all of the swab cups on the same core means have a uniform outside diameter.

7. The swabbing apparatus of claim 5 comprising at least three swab cups, all of which have different fluid load carrying capacities.

8. The swabbing apparatus of claim 4 wherein each swab cup has lips of uniform thickness.

9. The swabbing apparatus of claim 8 comprising at least three swab cups, all of which have different fluid load carrying capacities.

* * * * *